US010751791B2

(12) United States Patent
Ehara et al.

(10) Patent No.: US 10,751,791 B2
(45) Date of Patent: Aug. 25, 2020

(54) CONTINUOUS CASTING METHOD

(71) Applicant: NISSHIN STEEL CO., LTD., Tokyo (JP)

(72) Inventors: Yasuhiro Ehara, Tokyo (JP); Shun Saito, Tokyo (JP); Kazunari Morita, Tokyo (JP); Hiroshi Morikawa, Yamaguchi (JP)

(73) Assignee: NIPPON STEEL STAINLESS STEEL CORPORATION, Tokyo (JP)

( * ) Notice: Subject to any disclaimer, the term of this patent is extended or adjusted under 35 U.S.C. 154(b) by 0 days.

(21) Appl. No.: 16/332,028

(22) PCT Filed: Sep. 16, 2016

(86) PCT No.: PCT/JP2016/077415
§ 371 (c)(1),
(2) Date: Mar. 11, 2019

(87) PCT Pub. No.: WO2018/051483
PCT Pub. Date: Mar. 22, 2018

(65) Prior Publication Data

US 2019/0366423 A1 Dec. 5, 2019

(51) Int. Cl.

| | |
|---|---|
| ***B22D 11/115*** | (2006.01) |
| ***B22D 11/10*** | (2006.01) |
| ***B22D 11/20*** | (2006.01) |
| *C22C 38/54* | (2006.01) |
| *B22D 41/50* | (2006.01) |

(52) U.S. Cl.
CPC ..... *B22D 11/20* (2013.01); *B22D 11/10* (2013.01); *B22D 11/115* (2013.01); *B22D 41/50* (2013.01); *C22C 38/54* (2013.01)

(58) Field of Classification Search
CPC ..... B22D 11/10; B22D 11/115; B22D 11/20; B22D 41/50
See application file for complete search history.

(56) References Cited

U.S. PATENT DOCUMENTS 8,210,239 B2 * 7/2012 Toh ..... B22D 11/115 164/489

FOREIGN PATENT DOCUMENTS

| | | |
|---|---|---|
| JP | 05-317916 | 12/1993 |
| JP | 08-052549 | 2/1996 |
| JP | 10-166120 | 6/1998 |
| JP | 2004-098082 | 4/2004 |
| JP | 2008-246517 | 10/2008 |

* cited by examiner

*Primary Examiner* — Kevin E Yoon
(74) *Attorney, Agent, or Firm* — Clark & Brody LP

(57) ABSTRACT

A continuous casting method includes discharging a molten steel from discharge ports of a submerged nozzle under conditions (A) and (B); and performing electro-magnetic stirrer (EMS) to cause flows in directions inverse to each other in the long edge direction on both long edge sides in the molten steel in a region having a depth providing a thickness of a solidification shell of from 5 to 10 mm at least at a center position in the long edge direction. (A) a discharge extended line from the discharge port of the submerged nozzle intersects a molten steel surface in the mold at a point P, and the position of the point P satisfies $0.15 \leq M/W \leq 0.45$; and (B) a condition satisfying $0 \leq L - 0.17Vi \leq 350$, wherein the unit for L is mm, and Vi represents a discharge velocity (mm/s) of the molten steel at the outlet opening.

6 Claims, 2 Drawing Sheets

[Fig.1]
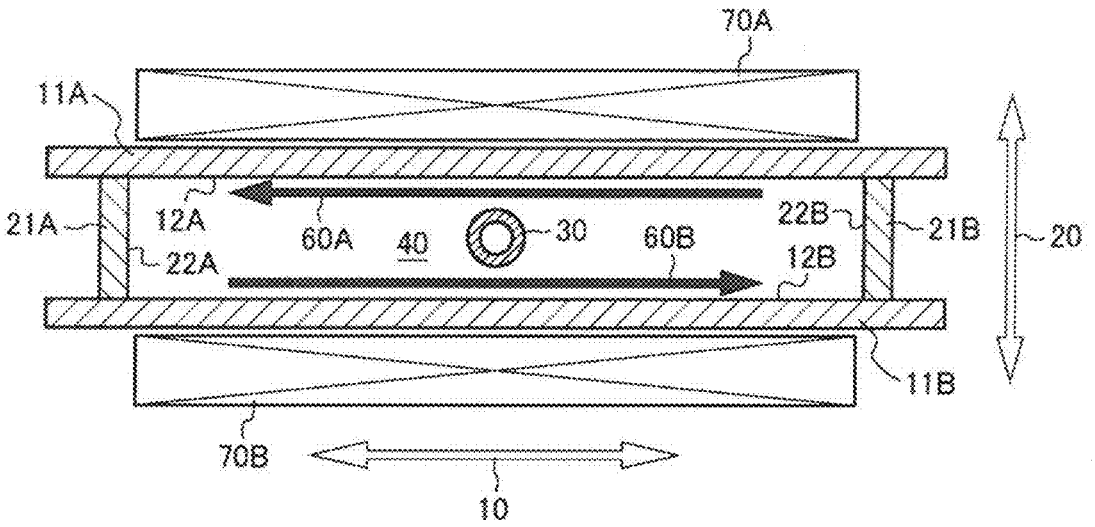
[Fig.2]
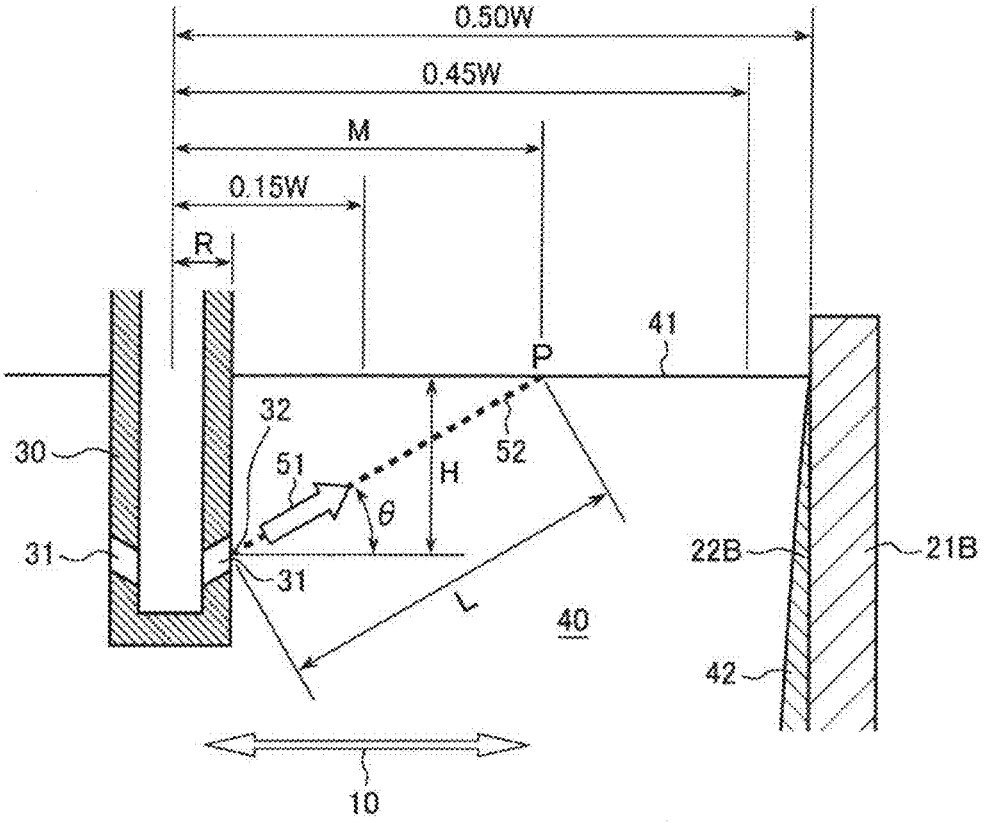

[Fig.3]
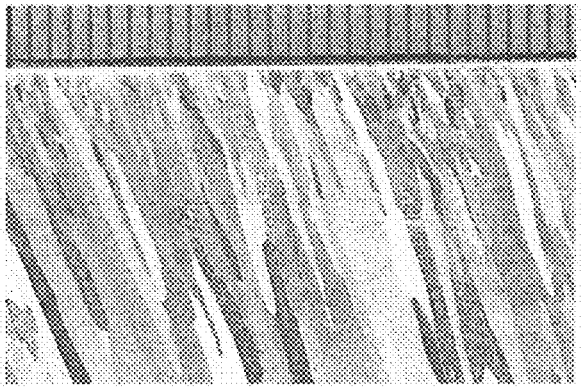
[Fig.4]
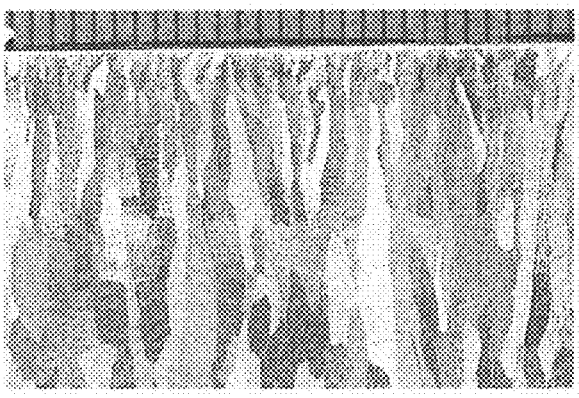

CONTINUOUS CASTING METHOD

TECHNICAL FIELD

The present invention relates to a continuous casting method for steel utilizing electro-magnetic stirrer (EMS).

BACKGROUND ART

As a continuous casting method for steel, a method of injecting molten steel into a mold (casting mold) with a submerged nozzle having two discharge ports has been widely employed. The molten steel discharged from the submerged nozzle unavoidably contains bubbles, non-metallic particles, and the like mixed therein. Representative examples of the bubbles include argon gas bubbles. Argon is blown into the molten steel in the process of refining, such as VOD and AOD, used as a seal gas for a tundish, or intentionally added to the molten steel flow channel for preventing clogging of the nozzle, but is substantially not dissolved in the molten steel, and thus tend to mix in the mold as bubbles. The non-metallic particles mainly include a part of such materials as a slag for refining, a deoxidation product formed in the refining process, a refractory as a constitutional material of a ladle and a tundish, and powder existing on a molten steel surface in a tundish, which are entrained into the molten steel, and flow into the mold along with the molten steel through the submerged nozzle. Separately, mold powder is added to the surface of the molten steel in the mold. The mold powder generally floats on the molten steel surface and covers the surface of the molten steel, and has functions, such as lubrication between a cast piece and the mold, heat retention, and antioxidation, and also a function trapping non-metallic particles emerging on the molten steel surface.

The bubbles and the non-metallic particles flowing into the molten steel in the mold float in the mold along with the flow of the molten steel, and those having a relatively large size tend to emerge near the molten steel surface, and may be entrained in some cases into the solidification shell (i.e., the surface layer portion of the cast piece) formed in the initial stage. The mold powder on the molten steel surface may also be entrained in some cases into the solidification shell in the initial stage. In the following description, the bubbles and the substances, such as the non-metallic particles and the mold powder, in the molten steel entrained into the solidification shell, and the substances having been entrained into the solidification shell are referred to as "foreign matters". The incorporation of foreign matters to the solidification shell may be a factor forming a defect (flaw) on the surface of the steel sheet obtained through the process including hot rolling and cold rolling.

In the continuous casting of steel, electro-magnetic stirrer (EMS) is effective as a measure for suppressing the incorporation of foreign matters to the solidification shell, and has been widely used (see, for example, PTL 1). It has been empirically confirmed that foreign matters can be prevented from being entrained into the solidification shell by making the molten steel in the vicinity of the solidification shell to flow forcedly.

In the case where the temperature of the molten steel surface in the mold is decreased, it is considered that the initial solidification shell may be formed with an uneven thickness due to the influence of the heat removal from the molten steel surface. The uneven initial solidification shell descends along the surface of the mold while exhibiting a craw-like cross section, and becomes a factor increasing the entrainment of foreign matters into the solidification shell. Accordingly, the retention of the temperature of the molten steel surface to a high temperature is also effective for suppressing the entrainment of foreign matters into the solidification shell.

PTL 2 describes that the discharge angle of the submerged nozzle is in a range of from 5 to 30 degrees upward from the horizontal direction (PTL 2, paragraph 0013). In the case where the casting rate is as small as 0.9 m/min or less, the inverse flow directed to the submerged nozzle from the short edge is small (ditto, paragraph 0021), and thus the temperature of the molten steel in the vicinity of the meniscus cannot be retained to a high temperature by the ordinary feed of the molten steel. The problem is then solved by directing the discharge angle of the nozzle upward from the horizontal direction, so as to facilitate the supply of heat to the meniscus (ditto, paragraph 0022). It is stated that in the case where the molten steel is discharged upward from the submerged nozzle, a flow thereof directed directly to the meniscus is formed, by which the molten steel having not been cooled with the mold is fed to the meniscus, so as to increase the temperature of the meniscus (ditto, paragraph 0023).

PTL 2 also describes a method of retaining the temperature of the molten steel in the vicinity of the meniscus to a high temperature by performing electro-magnetic stirring in the same direction on the long edge surfaces on both sides to increase or decrease the velocity of the inverse flow from the short edge, in the case where the casting rate is as large as approximately from 0.9 to 1.3 m/min or approximately 1.3 m/min or more (ditto, paragraphs 0025 to 0029). In this case, it is taught that the discharge angle may be relatively small (ditto, paragraph 0029), and 5° upward is employed in the example (ditto, Table 2). With a discharge angle of 5° upward, the discharged flow from the submerged nozzle is directed to the short edge surface, and the inverse flow from the short edge flows to the molten steel surface.

CITATION LIST

Patent Literatures

PTL 1: JP-A-2004-98082
PTL 2: JP-A-10-166120

SUMMARY OF INVENTION

Technical Problem

According to the description of PTL 2, it is stated that a cast piece excellent in surface cleanness without surface cracking can be obtained in such a manner that in the continuous casting, the discharge angle of the molten steel from the submerged nozzle is directed upward, and electro-magnetic stirring is performed appropriately. However, as a result of the repeated ingot experiments by the present inventors, it has been empirically found that even in the case where a good surface condition is obtained in the stage of the cast piece, the surface defects elicited in the stage where the cast piece is processed to a cold rolled steel sheet cannot be necessarily decreased significantly and stably. For example, in the method using a discharge angle of 5° upward with electro-magnetic stirrer (EMS) employed in combination, even in the case where the casting rate is as large as 0.9 m/min or more (i.e., in the case where the discharged flow amount is relatively large), the surface defects in the cold rolled steel sheet caused by the entrainment of foreign matters into the solidification shell cannot be sufficiently decreased in some cases, and the improvement in quality and the improvement in yield of the steel sheet cannot be achieved. Furthermore, it has also been found that even in the case where the discharge angle of the submerged nozzle is increased, for example, to approximately 30 degrees upward from the horizontal direction, and electro-magnetic stirrer (EMS) is employed in combination, the surface defects in the cold rolled steel sheet caused by the entrainment of foreign matters into the solidification shell cannot be necessarily decreased significantly and stably. In the case where the molten steel is a stainless steel, in particular, it is further difficult to provide a sufficient improvement effect. A stainless steel sheet has a larger number of applications attaching importance to a good surface appearance, as compared to a common steel sheet, and thus generally requires a higher standard for the improvement of the surface condition. This is considered to be one of the factors complicating the sufficient improvement effect for a stainless steel only by the application of the ordinary techniques.

An object of the invention is to provide a continuous casting technique that is capable of decreasing stably and significantly the surface defects in a cold rolled steel sheet caused by the entrainment of foreign matters to the solidification shell, even in the case where the technique is applied to continuous casting of a molten stainless steel.

Solution to Problem

It has been known that in the continuous casting of a steel, the prevention of decrease of the temperature of the surface of the molten steel in the mold is generally effective for decreasing the entrainment of foreign matters into the solidification shell. However, it is difficult to achieve the aforementioned object even though electro-magnetic stirrer is employed in combination. As a result of detailed investigations by the inventors, it has been found that in a molten steel flow discharged from a submerged nozzle by a method of discharging the molten steel from the submerged nozzle directed directly to the molten steel surface, the strict limitation of a molten steel flow that is directed to the short edge surface of the mold before reaching the molten steel surface is significantly effective for suppressing the entrainment of foreign matters into the solidification shell. At this time, it is important that the discharge condition is controlled in such a manner that the period of time of the molten steel flow discharged from the submerged nozzle until reaching the molten steel surface is prevented from becoming too long, and electro-magnetic stirrer (EMS) is employed in combination. Furthermore, the direction of the molten steel flow discharged from the submerged nozzle directly to the molten steel surface with convergence thereof while preventing the molten steel flow from being broadened is effective for ensuring the temperature of the molten steel surface.

However, in the continuous casting of steel, the operation where the direction of the discharged flow from the submerged nozzle is directed directly to the molten steel surface is difficult to perform practically in the commercially production. This is because such a discharging method may make the molten steel surface considerably wavy, and thereby there may be adverse effects that the thickness of the solidification shell formed becomes uneven, and the mold powder is entrained into the solidification shell. In this case, the wavy molten steel surface can be suppressed by decreasing the discharge velocity. However, the decrease of the discharge velocity may lead to the decrease of the temperature of the molten steel surface, and may also be a factor causing the deterioration in productivity. The inventors have found a measure capable of decreasing significantly the entrainment of foreign matters into the solidification shell while preventing the aforementioned adverse effects.

The following inventions are described for achieving the aforementioned object.

[1] The object can be achieved by a continuous casting method for steel, assuming that in continuous casting of steel using a mold having an inner surface of the mold in a rectangular profile shape cut in a horizontal plane, two inner wall surfaces of the mold constituting long edges of the rectangular shape each are referred to as a "long edge surface", two inner wall surfaces of the mold constituting short edges thereof each are referred to as a "short edge surface", a horizontal direction in parallel to the long edge surface is referred to as a "long edge direction", and a horizontal direction in parallel to the short edge surface is referred to as a "short edge direction", the continuous casting method including: disposing a submerged nozzle having two discharge ports, at a center in the long edge direction and the short edge direction in the mold; discharging a molten steel from each of the discharge ports under the following conditions (A) and (B); and applying electric power to the molten steel in a region having a depth providing a thickness of a solidification shell of from 5 to 10 mm at least at a center position in the long edge direction, so as to cause flows in directions inverse to each other in the long edge direction on both long edge sides, thereby performing electro-magnetic stirring (EMS):

(A) an extended line of a central axis of a discharged flow of the molten steel at an cutlet opening of the discharge port of the submerged nozzle (which is hereinafter referred to as a "discharge extended line") intersects a molten steel surface in the mold at a point P, and the molten steel is discharged from the discharge port of the submerged nozzle in a direction upward from the horizontal direction with a position of the point P satisfying the following expression (1):

$$0.15 \leq M/W \leq 0.45 \quad (1)$$

wherein W represents a distance (mm) between the short edges facing each other at a level of the molten steel surface, and M represents a distance (mm) in the long edge direction from a center position in the long edge direction between the short edges facing each ether to the point P; and (B) the molten steel is discharged from the discharge ports of the submerged nozzle to satisfy the following expression (2):

$$0 \leq L - 0.17Vi \leq 350 \quad (2)$$

wherein L represents a distance (mm) from a center position of the outlet opening of the discharge port of the submerged nozzle to the point P, and Vi represents a discharge velocity (mm/s) of the molten steel at the outlet opening of the discharge port.

[2] The continuous casting method according to the item [1], wherein the two discharge ports of the submerged nozzle each have an area of the outlet opening viewed in a discharge direction of from 950 to 3,500 $mm^2$.

[3] The continuous casting method according to the item [1] or [2], wherein L in the expression (2) is 450 mm or less.

[4] The continuous casting method according to any one of the items [1] to [3], wherein a casting rate is 0.90 m/min or more.

[5] The continuous casting method according to any one of the items [1] to [4], wherein the steel is a stainless steel having a C content of 0.12% by mass or less and a Cr content of from 10.5 to 32.0% by mass.

[6] The continuous casting method according to any one of the items [1] to [4], wherein the steel is a ferritic stainless steel containing, in terms of percentage by mass, from 0.001 to 0.080% of C, from 0.01 to 1.00% of Si, from 0.01 to 1.00% of Mn, from 0 to 0.60% of Ni, from 10.5 to 32.0% of Cr, from 0 to 2.50% of Mo, from 0.001 to 0.080% of N, from 0 to 1.00% of Ti, from 0 to 1.00% of Nb, from 0 to 1.00% of V, from 0 to 0.80% of Zr, from 0 to 0.80% of Cu, from 0 to 0.30% of Al, from 0 to 0.010% of B, and the balance of Fe, with unavoidable impurities.

Advantageous Effects of Invention

The application of the measure of the invention enables stable and significant decrease of the entrainment of foreign matters into the solidification shell, which unavoidably occurs in continuous casting of steel. In the case where argon gas is used as a seal gas for a tundish or as a gas for preventing clogging of a nozzle, bubbles of argon gas can be significantly prevented from being mixed in as foreign matters. According to the invention, therefore, a cold rolled steel sheet having high quality with significantly less surface defects caused by the foreign matters can be obtained without any particular mechanical or chemical removal treatment applied to the surface of the cast piece or the hot rolled steel sheet. The continuous casting method of the invention is particularly effective when applying to a stainless steel, which is desired to have a good surface appearance.

BRIEF DESCRIPTION OF DRAWINGS

FIG. 1 is a cross sectional view schematically exemplifying a cross sectional structure of a continuous casting apparatus capable of being applied to the invention, cut in the horizontal plane at the level of the molten steel surface of the molten steel in the mold.

FIG. 2 is a cross sectional view schematically exemplifying a cross sectional structure of a continuous casting apparatus capable of being applied to the invention, cut in the plane passing through the center position between the long edge surfaces facing each other.

FIG. 3 is a photograph of a metal structure of a continuously cast slab of a ferritic stainless steel according to the invention obtained by a method employing electro-magnetic stirrer, on the cross sectional surface perpendicular to the casting direction.

FIG. 4 is a photograph of a metal structure of a continuously cast slab of a ferritic stainless steel obtained by a method employing no electro-magnetic stirrer, on the cross sectional surface perpendicular to the casting direction.

DESCRIPTION OF EMBODIMENTS

FIG. 1 is a cross sectional view schematically exemplifying a cross sectional structure of a continuous casting apparatus capable of being applied to the invention, cut in the horizontal plane at the level of the molten steel surface of the molten steel in the mold. The "molten steel surface" means the liquid level of the molten steel. A layer of mold powder is generally formed on the molten steel surface. A submerged nozzle 30 is disposed at the center of the region surrounded by two pairs of molds (11A and 11B) and (21A and 22B) facing each other. The submerged nozzle has two discharge ports under the molten steel surface, and a molten steel 40 is continuously fed to the interior of the mold to form the molten steel surface at the prescribed height position in the mold. The mold has an inner wall surface of the mold in a rectangular profile shape cut in the horizontal plane, and in FIG. 1, the "long edge surfaces" constituting the long edges of the rectangular shape are denoted by the symbols 12A and 12B, and the "short edge surfaces" constituting the short edges thereof are denoted by the symbols 22A and 22B. The horizontal direction in parallel to the long edge surface is referred to as a "long edge direction", and the horizontal direction in parallel to the short edge surface is referred to as a "short edge direction". In FIG. 1, the long edge direction is shown by the white outline arrow with the symbol 10, and the short edge direction is shown thereby with the symbol 20. At the level of the molten steel surface, the distance between the long edge surfaces 12A and 12B may be, for example, from 150 to 300 mm, and the distance between the short edge surfaces 22A and 22B (which is W in FIG. 2 described later) may be, for example, from 600 to 2,000 mm.

Electro-magnetic stirrer devices 70A and 70B are disposed behind the molds 11A and 11B, and thereby a flowing force in the long edge direction can be applied to a region having a depth providing a thickness of the solidification shell of from 5 to 10 mm formed at least along the surfaces of the long edge surfaces 12A and 12B. The "depth" herein means a depth based on the level of the molten steel surface. The molten steel surface may fluctuate during the continuous casting, and in the description herein, the average level of the molten steel surface is designated as the position of the molten steel surface. The region having a depth providing a thickness of the solidification shell of from 5 to 10 mm generally exists in a range of a depth of 300 mm or less from the molten steel surface while depending on the casting rate and the heat removal rate from the mold. Accordingly, the electro-magnetic stirrer devices 70A and 70B are disposed at positions capable of applying a flowing force to the molten steel in a depth of approximately 300 mm from the molten steel surface.

In FIG. 1, the direction of the molten steel flows in the vicinity of the long edge surfaces formed through the electro-magnetic force of the electro-magnetic stirrer devices 70A and 70B in the region having a depth providing a thickness of the solidification shell of from 5 to 10 mm are shown by the black arrows 60A and 60B respectively. The flow directions by the electro-magnetic stirrer are in such a manner that flows in directions inverse to each other are formed in the long edge direction on both long edge sides. In this case, in the region having a depth providing a thickness of the solidification shell of approximately 10 mm, the flow of the molten steel in contact with the solidification shell having been formed eddies in the mold. The eddying flow can be smoothly retained without stagnation by controlling the discharged flow from the submerged nozzle in the manner described later, and thus the effect of washing out the foreign matters going to be entrained into the solidification shell again to the molten steel can be significantly exhibited over the entire long edge direction and short edge direction. In this manner, a steel sheet product having considerably less defects caused by foreign matters mixed therein in casting can be stably produced.

FIG. 2 is a cross sectional view schematically exemplifying a cross sectional structure of a continuous casting apparatus capable of being applied to the invention, cut in the plane passing through the center position between the long edge surfaces facing each other. In FIG. 2, the long edge direction is shown by the white outline arrow with the symbol 10. The submerged nozzle 30 has a bilaterally symmetric structure with respect to the center position, and therefore the portion including the submerged nozzle 30 and one of the mold 21B on the short edge side is shown. In FIG. 2, the symbol W means the distance between the short edge surfaces facing each other at the level of the molten steel surface. The distance between the center position of the submerged nozzle and the one of the short edge surface 22B is 0.5 W. The submerged nozzle 30 has discharge ports 31 on both sides in the long edge direction. The discharge port 31 is formed in such a manner that the discharge direction 51 of the molten steel is directed upward from the horizontal plane. The angle θ formed between the horizontal plane and the discharge direction 51 is referred to as a discharge angle. The discharged flow of the molten steel discharged from the outlet opening 32 of the discharge port 31 proceeds with certain broadening in the molten steel 40, and assuming that the center of the discharge flux at the position of the outlet opening 32 is referred to as an "central axis of the discharged flow", the direction in which the molten steel at the central axis of the discharged flow proceeds can be defined as a "discharge direction". The straight line extending in the discharge direction from the center point of the discharge flux at the position of the cutlet pert 32 as the starting point is defined as an "extended line of the center axis of the discharged flow". In the following description, the extended line of the center axis of the discharged flow is referred to as a "discharged extended line". In FIG. 2, the discharged extended line is denoted by the symbol 52. The intersection point of the discharged extended line 52 and the molten steel surface 41 is referred to as a point P.

In the invention, the molten steel is discharged from both the two discharge ports 31 in a direction upward from the horizontal direction with the position of the intersection point P of the discharge extended line 52 and the molten steel surface 41 satisfying the following expression (1):

$$0.15 \leq M/W \leq 0.45 \quad (1)$$

wherein W represents the distance (mm) between the short edges facing each other at the level of the molten steel surface, and M represents the distance (mm) in the long edge direction from the center position in the long edge direction between the short edges facing each other to the point P.

In the case where the expression (1) is satisfied, the position of the point P is in a range where M is 0.15 W or more and 0.45 W or less in FIG. 2. In the case where such a discharge direction is employed, the heat of the discharged molten steel can be efficiently distributed over the entire molten steel surface, and the temperature of the entire molten steel surface can be retained to a high temperature. Furthermore, it has been found that the discharged flow satisfying the expression (1) is difficult to inhibit the formation of the aforementioned eddying flow formed through the electro-magnetic stirrer. Accordingly, the smooth eddying flow can be retained, and thereby the effect of suppressing the entrainment of foreign matters into the solidification shell can be significantly enhanced. In the case where M/W is less than 0.15 (i.e., M is smaller than 0.15 W), the period of time until the discharged flow reaches the molten steel surface in the vicinity of the short edge surface is prolonged, and the temperature of the molten steel surface tends to be decreased in the vicinity of the short edge surface. The decrease of the temperature of the molten steel surface may cause the formation of the uneven initial solidification shell having a craw-like cross section, which becomes a factor increasing the entrainment of foreign matters. In the case where M/W exceeds 0.45 (i.e., M is larger than 0.45 W), on the other hand, not only the temperature of the molten steel surface near the center in the long edge direction tends to be decreased, but also in the discharged flow from the submerged nozzle, the flow that is directed to the short edge surface but does not reach directly the molten steel surface is increased, thereby decreasing the average temperature of the entire molten steel surface. Furthermore, the flow of the discharged flow directed to the short edge surface may be a factor disturbing the eddying flow formed through the electro-magnetic stirrer. In this case, the flow formed through the electro-magnetic stirrer may be locally unstable, and the entrainment of foreign matters tends to occur on the surface of the solidification shell in the portion with the flow going to stagnate.

The application of the condition satisfying the following expression (1)' instead of the expression (1) is more effective.

$$0.20 \leq M/W \leq 0.40 \quad (1)'$$

It is important that the molten steel is discharged from both the two discharge ports 31 to satisfy the following expression (2):

$$0 \leq L - 0.17Vi \leq 350 \quad (2)$$

wherein L represents a distance (mm) from the center position of the outlet opening of the discharge port of the submerged nozzle to the point P, and Vi represents a discharge velocity (mm/s) of the molten steel at the outlet opening of the discharge port. The center position of the outlet opening is the center point of the discharged flux at the position of the outlet opening 32, i.e., the starting point of the discharge extended line.

L is shown in FIG. 2. Vi may be a value of the average discharge velocity (mm/s) determined by dividing the discharge amount ($mm^3/s$) of the molten steel from the discharge port per unit time by the area ($mm^2$) of the outlet opening viewed in the discharge direction (i.e., the direction of the discharge extended line). There may be a case where the mold for continuous casting has a tapered shape, in which the cross sectional dimension of the inner surfaces thereof is slightly decreased from the upper end to the lower end, in consideration of the solidification shrinkage. In this case, the dimension of the mold at the level of the molten steel surface may be employed with no problem for obtaining the discharge amount of the molten steel per unit time from the casting rate and the dimension of the mold for calculating Vi. The temperature of the molten steel reaching the molten steel surface is decreased when the period of time thereof until reaching the molten steel surface is prolonged. The period of time until reaching the molten steel surface is necessarily evaluated in consideration of the decrease in velocity in the molten steel, in addition to the distance L between the outlet of the discharge port to the molten steel surface, and the discharge velocity Vi. The term L−0.17Vi in the expression (2) is the index of the decrease in temperature taking the aforementioned factors into consideration. The inventors have found based on the experimental results utilizing many ingot charges that the condition satisfying the expression (2) can stably retain the temperature of the molten steel surface to a high temperature, and the entrainment of foreign matters into the solidification shell can be stably suppressed. At this time, the discharge direction satisfying the expression (1) is the prerequisite of the application of the expression (2).

The value of L−0.17Vi in the expression (2) is advantageously as small as possible for retaining the temperature of the molten steel surface to a high temperature. However, in the case where the value of L−0.17Vi becomes less than 0, the wavy molten steel surface becomes excessive due to the discharged flow directly reaching the molten steel surface, and thereby the possibility of the entrainment of the mold powder existing on the molten steel surface into the solidification shell as foreign matters is rapidly increased. On the other hand, the condition where the value of L−0.17Vi exceeds 350 greatly decreases the temperature of the discharged flow until reaching the molten steel surface, and the effect of suppressing the entrainment of foreign matters into the solidification shell by retaining the temperature of the molten steel surface to a high temperature is weakened even with the discharge direction satisfying the expression (1).

The application of the condition satisfying the following expression (2)' instead of the expression (2) is more effective.

$$20 \leq L - 0.17Vi \leq 300 \quad (2)'$$

For controlling the discharge condition to satisfy the expression (1) or the expression (1)', the discharge angle of the submerged nozzle and the submerged depth of the submerged nozzle may be controlled. For controlling the discharge condition to satisfy the expression (2) or the expression (2)', the discharge velocity Vi may further be controlled. The discharge velocity Vi depends on the size of the discharge opening (i.e., the area of the outlet opening viewed in the discharge direction) and the discharge amount of the molten steel per unit time.

The size of the outlet opening of the discharge port of the submerged nozzle not only influences the discharge velocity Vi but also influences the mode of broadening of the discharged flux. According to the investigations made by the inventors, it has been found that the use of the submerged nozzle having a discharge port with an outlet, opening having a small size can increase the discharge velocity Vi in ensuring a constant discharged flow amount, and in addition is advantageous for suppressing the broadening of the discharged flux. With the smaller broadening of the discharged flow velocity, the interference thereof to the molten steel flow caused by the electro-magnetic stirrer can be prevented, and the electric power of the electro-magnetic stirrer required for forming the stable eddying flow can be decreased. Accordingly, the use of the submerged nozzle with an outlet opening having a small size is significantly effective for enhancing the degree of freedom in setting the electro-magnetic stirrer condition. As a result of the various investigations, the use of the submerged nozzle having two discharge ports each having an area of an outlet opening of from 950 to 3,500 $mm^2$ viewed in the discharge direction (i.e., the direction of the discharge extended line) is more preferred. The area of the outlet opening may be more effectively from 950 to 3,000 $mm^2$. In the case where the area of the outlet opening is less than 950, such problems as clogging of the nozzle and the like tend to occur.

In the case where the L in the expression (2) (i.e., the distance from the center position of the outlet opening of the discharge port of the submerged nozzle to the point P) is long, the influence of the broadening of the discharged flow tends to be large. As a result of the various investigations, it has been found that in the case where the molten steel is discharged under the condition providing L of 450 mm or less, the interference thereof to the eddying flow caused by the electro-magnetic stirrer can be decreased, so as to enhance the effect of washing out the foreign matters by the electro-magnetic stirred flow, and thus the elicitation of the surface defects in the cold rolled steel sheet can be further efficiently suppressed. However, in the case where the L is too small, the degree of freedom of the discharge velocity Vi for satisfying the expression (2) becomes small. The value of L is preferably ensured to be 200 mm or more. It is more effective that the submerged nozzle with the cutlet opening having an area controlled as described above is used, and simultaneously the value of L is 450 mm or less.

It has been considered that in the case where the casting rate is large, the discharge velocity is also increased accompanied thereby, and thus it is difficult to increase the upward discharge angle, so as to direct the discharged molten steel directly to the molten steel surface. However, under the discharge condition satisfying the expression (2), the sufficient discharged amount can be ensured in such a range that the molten steel surface does not become considerably wavy. Accordingly, even in the case where the casting rate is large, the entrainment of foreign matters into the solidification shell can be significantly suppressed through the increase and homogenization of the temperature of the molten steel surface. In particular, the invention can exert the excellent effect at a casting rate of 0.90 m/min or more or exceeding 0.90 m/min. The upper limit of the casting rate may depend on the equipment capacity, and may be generally 1.80 m/min or less or may be managed to 1.60 m/min or less.

The velocity of the flow of the molten steel through the electro-magnetic stirrer may be such a value that provides an average flow velocity in the long edge direction of the molten steel in contact with the surface of the solidification shell, for example, of from 100 to 600 mm/s, in a region having a depth providing a thickness of the solidification shell of from 5 to 10 mm at the center position in the long edge direction. The velocity may be managed to be from 200 to 400 mm/s. The flow velocity in the long edge direction of the molten steel in contact with the surface of the solidification shell can be confirmed by observing the metal structure of the manufactured cast piece on the cross section perpendicular to the casting direction.

FIG. 3 exemplifies a photograph of a metal structure of a continuously cast slab of a ferritic stainless steel according to the invention obtained by a method employing electro-magnetic stirrer, on the cross sectional surface perpendicular to the casting direction. The upper end surface in the photograph is the surface obtained through the contact with the long edge surface of the mold (i.e., the surface on the end in the thickness direction of the cast slab), and the lateral direction in the photograph is the long edge direction. The specimen observed is collected from the portion near the center in the long edge direction. One graduation of the scale is 1 mm. It has been known that in the case where a molten metal flows with respect to a mold, the solidification of crystals proceeds with an inclination toward the upstream side of the flow, and the inclination angle of the crystal growth is increased with the increase of the flow velocity. In the example shown in FIG. 3, the growth direction of the column crystals is inclined right. Accordingly, it is understood therefrom that the molten steel in contact with the solidification shell flows from right to left in the photograph. The relationship between the flow velocity of the molten steel in contact, with the solidification shell and the inclination angle of the crystal growth can be known, for example, by a solidification experiment using a rotating rod-shaped heat-removing body. The flow velocity of the molten steel in contact with the solidification shell in the continuous casting can be estimated based on the data collected by the laboratory experiments in advance. In the example shown in FIG. 3, the average flow velocity in the long edge direction of the molten steel in contact with the surface of the solidification shell in the region providing a thickness of the solidification shell of from 5 to 10 mm is estimated to be approximately 300 mm/s from the average inclination angle of the column crystals at the position distant from the surface by from 5 to 10 mm. For an austenite stainless steel, the flow velocity of the molten steel in contact with the surface of the solidification shell can be evaluated by reading the inclination angle of the dendrite primary arm.

FIG. 4 exemplifies a photograph of a metal structure of a continuously cast slab of a ferritic stainless steel obtained by a method employing no electro-magnetic stirrer, on the cross sectional surface perpendicular to the casting direction. The position of the specimen observed is the same as in FIG. 3. One graduation of the scale is 1 mm. In this case, there is no inclination in the growth direction of the column crystals. Accordingly, it is understood that the portion with a thickness of the solidification shell of from 5 to 10 mm of the cast piece is solidified in a state where no flow occurs in the long edge direction in the molten steel.

Except for the control of the discharge condition from the submerged nozzle to the aforementioned condition, and the electro-magnetic stirring (EMS) performed in the aforementioned manner, the ordinary continuous casting method can be applied. For example, a method of providing another electro-magnetic stirrer device in the lower region inside the mold to form a vertically upward flow of the molten steel may be applied. In this case, an effect of further preventing the entrainment of foreign matters into the solidification shell may be expected.

The continuous casting method of the invention is effective for various steel species that have been produced by applying a continuous casting method. The continuous casting method is more effective for a stainless steel, which is frequently required to have a good surface appearance. The stainless steel is an alloy steel having a C content of 0.12% by mass or less and a Cr content of 10.5% by mass or more, as defined in JIS G0203:2009, No. 3801. An excessive Cr content may cause deterioration of the productivity and increase of the cost, and thus the Cr content is preferably 32.0% by mass or less. More specific examples of the standard steel species of the stainless steel include the various species shown in JIS G4305:2012.

Specific examples of the component, composition thereof include a ferritic stainless steel containing, in terms of percentage by mass, from 0.001 to 0.080% of C, from 0.01 to 1.00% of Si, from 0.01 to 1.00% of Mn, from 0 to 0.60% of Ni, from 10.5 to 32.0% of Cr, from 0 to 2.50% of Mo, from 0.001 to 0.080% of N, from 0 to 1.00% of Ti, from 0 to 1.00% of Nb, from 0 to 1.00% of V, from 0 to 0.80% of Zr, from 0 to 0.80% of Cu, from 0 to 0.30% of Al, from 0 to 0.010% of B, and the balance of Fe, with unavoidable impurities. In the aforementioned ferritic stainless steel, in particular, the application of the invention is considerably effective for a so-called ferritic single phase steel species, in which the C content is restricted to from 0.001 to 0.030% by mass and the N content is restricted to from 0.001 to 0.025% by mass. For the ferritic steel with a low C content and a low N content, such an operation is employed that the molten steel in the tundish is prevented from being in contact with a nitrogen component as much as possible, and in the case where such an operation is performed that the gas phase portion in the tundish is sealed with argon gas for preventing the contact with a nitrogen component, the argon gas bubbles carried over to the mold can be effectively prevented from being entrained into the solidification shell.

EXAMPLES

Example 1

The ferritic stainless steels having the chemical compositions shown in Table 1 were cast with a continuous casting apparatus to produce cast pieces (slabs).

TABLE 1

| | Chemical composition (% by mass) | | | | | | | | | | | | |
|---|---|---|---|---|---|---|---|---|---|---|---|---|---|
| Steel No. | C | Si | Mn | Ni | Cr | Cu | Mo | Ti | Al | Nb | V | N | Others |
| 1 | 0.075 | 0.586 | 0.429 | 0.17 | 16.13 | — | — | — | — | — | — | 0.018 | — |
| 2 | 0.061 | 0.400 | 0.260 | 0.12 | 16.01 | — | — | — | — | — | — | 0.011 | — |
| 3 | 0.061 | 0.680 | 0.440 | 0.12 | 16.28 | 0.03 | 0.06 | 0.012 | 0.005 | — | 0.160 | 0.016 | — |
| 4 | 0.006 | 0.492 | 0.189 | 0.15 | 11.13 | — | — | 0.235 | 0.060 | — | — | 0.008 | — |
| 5 | 0.006 | 0.090 | 0.100 | 0.15 | 17.82 | 0.04 | 1.04 | 0.352 | 0.033 | — | 0.070 | 0.012 | — |
| 6 | 0.003 | 0.255 | 0.153 | 0.16 | 15.41 | 0.06 | 0.51 | 0.250 | 0.103 | — | 0.054 | 0.010 | B: 0.001 |
| 7 | 0.006 | 0.040 | 0.160 | 0.17 | 17.58 | 0.07 | 0.91 | 0.268 | 0.182 | — | 0.070 | 0.013 | — |
| 8 | 0.063 | 0.420 | 0.760 | 0.14 | 16.14 | 0.06 | 0.17 | 0.003 | — | — | 0.120 | 0.035 | — |
| 9 | 0.004 | 0.050 | 0.070 | 0.12 | 18.14 | 0.04 | 1.05 | 0.262 | 0.246 | — | 0.050 | 0.012 | Zr: 0.10 |
| 10 | 0.006 | 0.070 | 0.120 | 0.19 | 17.65 | 0.05 | 0.92 | 0.271 | 0.267 | — | 0.060 | 0.010 | — |
| 11 | 0.010 | 0.540 | 0.330 | 0.33 | 19.93 | 0.47 | 0.05 | — | — | 0.358 | — | 0.011 | — |
| 12 | 0.010 | 0.470 | 0.350 | 0.26 | 19.04 | 0.57 | 0.02 | — | — | 0.354 | — | 0.013 | — |
| 13 | 0.067 | 0.440 | 0.850 | 0.13 | 16.19 | 0.07 | 0.10 | — | — | — | 0.150 | 0.026 | — |
| 14 | 0.008 | 0.080 | 0.260 | 0.14 | 11.51 | 0.06 | 0.09 | 0.250 | 0.030 | — | 0.040 | 0.007 | — |
| 15 | 0.073 | 0.656 | 0.324 | 0.16 | 16.12 | — | — | — | — | — | — | 0.016 | — |
| 16 | 0.006 | 0.540 | 0.230 | 0.34 | 18.46 | 0.47 | 0.03 | — | — | 0.452 | — | 0.011 | — |
| 17 | 0.006 | 0.060 | 0.110 | 0.12 | 17.75 | 0.04 | 1.13 | 0.276 | 0.044 | — | 0.050 | 0.013 | — |
| 18 | 0.071 | 0.680 | 0.373 | 0.14 | 16.19 | 0.04 | 0.05 | 0.016 | — | — | 0.137 | 0.014 | — |
| 19 | 0.007 | 0.110 | 0.170 | 0.16 | 11.55 | 0.05 | 0.06 | 0.250 | 0.028 | — | 0.040 | 0.008 | — |
| 20 | 0.007 | 0.120 | 0.240 | 0.14 | 11.87 | 0.06 | 0.10 | 0.254 | 0.023 | 0.006 | 0.040 | 0.009 | — |
| 21 | 0.007 | 0.093 | 0.164 | 0.18 | 29.34 | 0.05 | 1.95 | 0.164 | 0.117 | 0.171 | 0.117 | 0.015 | — |
| 22 | 0.007 | 0.320 | 0.990 | — | 18.32 | 0.22 | 2.00 | 0.004 | — | 0.616 | — | 0.009 | — |
| 23 | 0.009 | 0.270 | 0.190 | 0.17 | 21.87 | 0.04 | 1.03 | 0.200 | 0.081 | 0.189 | 0.070 | 0.014 | — |
| 24 | 0.007 | 0.209 | 0.211 | 0.16 | 19.40 | 0.05 | 1.22 | 0.107 | 0.069 | 0.312 | 0.026 | 0.012 | — |
| 25 | 0.007 | 0.100 | 0.270 | 0.18 | 16.52 | 0.05 | 0.10 | 0.195 | 0.022 | 0.246 | 0.050 | 0.010 | — |
| 26 | 0.006 | 0.730 | 0.250 | 0.14 | 11.15 | 0.06 | 0.06 | 0.234 | 0.069 | — | 0.030 | 0.006 | — |
| 27 | 0.009 | 0.270 | 0.190 | 0.17 | 21.87 | 0.04 | 1.03 | 0.200 | 0.081 | 0.189 | 0.070 | 0.014 | — |
| 28 | 0.005 | 0.100 | 0.160 | 0.17 | 29.39 | 0.02 | 1.97 | 0.170 | 0.106 | 0.200 | 0.110 | 0.012 | — |

The size of the mold for the continuous casting at the level of the molten steel surface was set to 200 mm for the short edge length and a range of from 700 to 1,650 mm for the long edge length (i.e., W in FIG. 2). The dimension at the lower end of the mold was slightly smaller than the aforementioned size in consideration of the solidification shrinkage. The casting rate was set to a range of from 0.50 to 1.50 m/min. Electro-magnetic stirrer devices were disposed on the back sides of the molds of the long edges facing each other, and electro-magnetic stirring was performed to impart a flowing force in the long edge direction to the molten steel in the region of from the depth position in the vicinity of the molten steel surface to the depth position of approximately 200 mm in the mold. As shown in FIG. 1, the flow directions on the both long edge edges facing each other were made inverse to each other. The electro-magnetic stirring force was the same as in all the examples. The average flow velocity in the long edge direction of the molten steel in contact with the surface of the solidification shell in the region providing a depth of the solidification shell of from 5 to 10 mm was approximately 300 mm/s at the center position in the long edge direction for both the long edge sides.

A submerged nozzle having two discharge ports on both sides in the long edge direction was disposed at the center position in the long edge direction and the short edge direction. The submerged nozzle had an outer diameter of 105 mm. The two discharge ports were disposed symmetrically with respect to a plane passing through the center of the nozzle and in parallel to the short edge surface. The discharge direction (i.e., θ in FIG. 2) was set to a range of from 5 to 45°. The area of the outlet opening of one of the discharge port viewed in the discharge direction was 2,304 $mm^2$ (which is common in all the examples). The discharge extended line (denoted by the symbol 52 in FIG. 2) was on the plane passing through the center position of the long edge surface facing each other. The radius from the center of the submerged nozzle to the starting point of the discharge extended line (i.e., R in FIG. 2) was 52.5 mm.

FIGS. 2A and 2B show the major continuous casting conditions. The numbers of Examples in Tables 2A and 2B correspond to the numbers of Steels in Table 1 respectively. Herein, operation examples using argon gas as a seal gas in the gas phase portion in the tundish are shown (which is common all the examples). The depth of the outlet opening of the discharge port of the submerged nozzle (i.e., H in FIG. 2, the depth of the center position of the outlet opening from the molten steel surface) was controlled by changing the submerged depth of the submerged nozzle. The "mold size" in Table 2 means the size at the level of the molten steel h surface. The "electro-magnetic stirrer flow velocity" in Tables 2A and 2B means the average flow velocity in the long edge direction at the center position in the long edge direction of the molten steel in contact with the surface of the solidification shell in the region having a depth providing a thickness of the solidification shell of from 5 to 10 mm.

In consideration of comparative examples having a discharge extended line that does not intersect the molten steel surface, in Tables 2A and 2B, the "distance in the long edge direction from the center position in the long edge direction between the short edges facing each other to the intersection point of the horizontal plane including the molten steel surface and the discharge extended line" is shown as the geometric distance M, and the "distance from the center position of the outlet opening of the discharge port of the submerged nozzle to the horizontal plane including the molten steel surface" is shown as the geometric distance L. In the examples of the invention, the geometric distance M in Tables 2A and 2B corresponds to M in FIG. 2 (i.e., the distance in the long edge direction from the center position in the long edge direction between the short edges facing each other to the point P), and the geometric distance L therein corresponds to L in FIG. 2 (i.e., the distance from the center position of the outlet opening of the discharge port of the submerged nozzle to the point P). In Tables 2A and 2B, whether or not the expression (1) of the expression (2) is satisfied is shown by "pass" for the case where the expression is satisfied, and by "fail" for the case where the expression is not satisfied. In Tables 2A and 2B, an example with a value of M/W exceeding 0.50 means that the discharge extended line does not intersect the molten steel surface.

A calculation example of M/W in the expression (1) and L−0.17Vi in the expression (2) is shown by taking No. 1 in Table 2A as an example. Reference may be made to FIG. 2 for convenience.

Calculation Example of M/W in Expression (1)

In No. 1 in Table 2A as an example, the depth of the outlet opening H=180 mm and the discharge angle θ=30° C., from which the geometric distance M is R+130/tan θ=52.5+311.8=364.3 mm. The geometric distance L is H/sin θ=180/0.5=360 mm. The distance W between the short edges facing each other at the level of the molten steel surface is 1,250 mm, from which M/W=364.3/1,250=0.291. The value satisfies the expression (1).

Calculation Example of L−0.17Vi in Expression (2)

In No. 1 in Table 2A as an example, the casting rate is 1.00 m/min=16.67 mm/s, the size of the mold at the level of the molten steel surface is 200 mm×1,250 mm=250,000 $mm^2$, and the number of the discharge ports is 2, from which the discharge amount of the molten steel from one discharge port per unit time is 250,000×16.67/2=2,083,750 $mm^3/s$. The area of the outlet opening viewed in the discharge direction (i.e., the direction of the discharge extended line) is 2,304 $mm^2$, from which the discharge velocity Vi of the molten steel at the outlet opening is 2,083,750/2,304=904.2 mm/s. Accordingly, L−0.17Vi=360−0.17×904.2=206.3. The value satisfies the expression (2).

The resulting cast pieces (continuous cast slabs) each were subjected to the ordinary production process of a ferritic stainless steel (including hot rolling, annealing, acid pickling, cold rolling, annealing, and acid pickling), so as to produce a coil of a cold rolled annealed steel sheet having a sheet, thickness of 1 mm. A surface inspection for the entire width on one surface was performed over the entire length of the coil, and blocks of 1 m obtained by segmenting the coil in the longitudinal direction each were inspected as to whether or not a surface defect was detected in the block. In the case where at least one surface defect was detected in the block of 1 m, the block was designated as a "block having surface defect", and the number proportion of the "block having surface defect" occupied in the total number of blocks in the entire length of the coil is designated as the defect occurrence rate (%) of the coil. The detection of a surface defect was performed by the combination of the method of detecting a disorder of the surface profile under irradiation of the entire width of the coil in threading with laser light and the visual observation, for all the coils with the same standard. The procedure can detect a surface defect caused by foreign matters (such as non-metallic particles, bubbles, and powder) entrained into the solidification shell in the continuous casting, with high accuracy. A ferritic stainless steel cold rolled annealed steel sheet that has a defect occurrence rate of 2.5% or less can be expected to achieve a large effect of enhancing the yield of the product even in an application attaching importance to a good surface appearance. Accordingly, the case where the defect occurrence rate is 2.5% or less is evaluated as "pass", and the others are evaluated as "fail". The results are shown in Tables 2A and 2B.

TABLE 2A

| Example No. | Mold size: Short edge (mm) | Mold size: Long edge W (mm) | Submerged nozzle: Depth H of center of outlet opening (mm) | Submerged nozzle: Discharge angle θ (°) | Casting rate (m/min) | Discharge velocity Vi (mm/s) | Geometric distance: M (mm) | Geometric distance: L (mm) | Expression (1) M/W |
|---|---|---|---|---|---|---|---|---|---|
| 1 | 200 | 1250 | 180 | 30 | 1.00 | 904.2 | 364.3 | 360.0 | 0.291 |
| 2 | 200 | 1570 | 180 | 30 | 1.00 | 1135.7 | 364.3 | 360.0 | 0.232 |
| 3 | 200 | 1030 | 200 | 30 | 1.00 | 745.1 | 398.9 | 400.0 | 0.387 |
| 4 | 200 | 1030 | 180 | 30 | 0.91 | 678.0 | 364.3 | 360.0 | 0.354 |
| 5 | 200 | 1250 | 180 | 30 | 0.95 | 859.0 | 364.3 | 360.0 | 0.291 |
| 6 | 200 | 1570 | 150 | 30 | 0.92 | 1044.8 | 312.3 | 300.0 | 0.199 |
| 7 | 200 | 1030 | 130 | 30 | 1.40 | 1043.1 | 277.7 | 260.0 | 0.270 |
| 8 | 200 | 1250 | 110 | 30 | 0.95 | 859.0 | 243.0 | 220.0 | 0.194 |
| 9 | 200 | 1570 | 110 | 30 | 0.92 | 1044.8 | 243.0 | 220.0 | 0.155 |
| 10 | 200 | 1030 | 110 | 30 | 1.00 | 745.1 | 243.0 | 220.0 | 0.236 |
| 11 | 200 | 1250 | 110 | 30 | 1.00 | 904.2 | 243.0 | 220.0 | 0.194 |
| 12 | 200 | 1570 | 110 | 30 | 1.00 | 1135.7 | 243.0 | 220.0 | 0.155 |

| Example No. | Expression (1): Judgement of sufficiency | Expression (2): L-0.17Vi | Expression (2): Judgement of sufficiency | Flow velocity by electro-magnetic stirrer (mm/s) | Cold rolled annealed steel sheet: Defect occurrence rate (%) | Cold rolled annealed steel sheet: Evaluation of defect occurrence | Class |
|---|---|---|---|---|---|---|---|
| 1 | pass | 206.3 | pass | 300 | 2.1 | pass | invention |
| 2 | pass | 166.9 | pass | 300 | 0.8 | pass | invention |
| 3 | pass | 273.3 | pass | 300 | 1.2 | pass | invention |
| 4 | pass | 244.7 | pass | 300 | 1.4 | pass | invention |
| 5 | pass | 214.0 | pass | 300 | 0.9 | pass | invention |
| 6 | pass | 122.4 | pass | 300 | 1.4 | pass | invention |
| 7 | pass | 82.7 | pass | 300 | 1.7 | pass | invention |
| 8 | pass | 74.0 | pass | 300 | 1.5 | pass | invention |
| 9 | pass | 42.4 | pass | 300 | 1.2 | pass | invention |
| 10 | pass | 93.3 | pass | 300 | 2.3 | pass | invention |
| 11 | pass | 66.3 | pass | 300 | 1.9 | pass | invention |
| 12 | pass | 26.9 | pass | 300 | 0.9 | pass | invention |

TABLE 2B

| Example No. | Mold size: Start edge (mm) | Mold size: Long edge W (mm) | Submerged nozzle: Depth H of center of outlet opening (mm) | Submerged nozzle: Discharge angle θ (°) | Casting rate (m/min) | Discharge velocity Vi (mm/s) | Geometric distance: M (mm) | Geometric distance: L (mm) | Expression (1) M/W |
|---|---|---|---|---|---|---|---|---|---|
| 13 | 200 | 1030 | 160 | 15 | 1.40 | 1043.1 | 649.6 | 618.2 | 0.631 |
| 14 | 200 | 1250 | 180 | 15 | 1.40 | 1265.9 | 724.3 | 695.5 | 0.579 |
| 15 | 200 | 1570 | 180 | 15 | 1.40 | 1590.0 | 724.3 | 695.5 | 0.461 |
| 16 | 200 | 1030 | 180 | 5 | 1.40 | 1043.1 | 2109.9 | 2065.3 | 2.048 |
| 17 | 200 | 1250 | 180 | 5 | 1.40 | 1265.9 | 2109.9 | 2065.3 | 1.688 |
| 18 | 200 | 1570 | 180 | 5 | 1.40 | 1590.0 | 2109.9 | 2065.3 | 1.344 |
| 19 | 200 | 1570 | 80 | 30 | 0.92 | 1044.8 | 191.1 | 160.0 | 0.122 |
| 20 | 200 | 1570 | 280 | 30 | 0.92 | 1044.8 | 537.5 | 560.0 | 0.342 |
| 21 | 200 | 1250 | 280 | 30 | 0.92 | 831.9 | 537.5 | 560.0 | 0.430 |
| 22 | 200 | 1030 | 220 | 30 | 1.50 | 1117.6 | 433.6 | 440.0 | 0.421 |
| 23 | 200 | 1570 | 220 | 30 | 0.50 | 567.9 | 433.6 | 440.0 | 0.276 |
| 24 | 200 | 1570 | 80 | 30 | 1.00 | 1135.7 | 191.1 | 160.0 | 0.122 |
| 25 | 200 | 1250 | 100 | 30 | 1.40 | 1265.9 | 225.7 | 200.0 | 0.181 |
| 26 | 200 | 700 | 120 | 30 | 1.50 | 759.5 | 260.3 | 240.0 | 0.372 |
| 27 | 200 | 700 | 80 | 15 | 1.50 | 759.5 | 351.1 | 309.1 | 0.502 |
| 28 | 200 | 1650 | 280 | 45 | 0.91 | 1086.2 | 332.5 | 396.0 | 0.202 |

TABLE 2B-continued

| Example No. | Expression (1) Judgement of sufficiency | Expression (2) L-0.17Vi | Expression (2) Judgement of sufficiency | Flow velocity by electro-magnetic stirrer (mm/s) | Cold rolled annealed steel sheet Defect occurrence rate (%) | Cold rolled annealed steel sheet Evaluation of defect occurrence | Class |
|---|---|---|---|---|---|---|---|
| 13 | fail | 440.9 | fail | 300 | 3.8 | fail | comparison |
| 14 | fail | 480.3 | fail | 300 | 3.3 | fail | comparison |
| 15 | fail | 425.2 | fail | 300 | 3.5 | fail | comparison |
| 16 | fail | 1887.9 | fail | 300 | 3.8 | fail | comparison |
| 17 | fail | 1850.1 | fail | 300 | 4.2 | fail | comparison |
| 18 | fail | 1795.0 | fail | 300 | 4.1 | fail | comparison |
| 19 | fail | −17.6 | fail | 300 | 6.2 | fail | comparison |
| 20 | pass | 382.4 | fail | 300 | 3.5 | fail | comparison |
| 21 | pass | 418.6 | fail | 300 | 4.1 | fail | comparison |
| 22 | pass | 250.0 | pass | 300 | 1.3 | pass | invention |
| 23 | pass | 343.5 | pass | 300 | 1.9 | pass | invention |
| 24 | fail | −33.1 | fail | 300 | 5.3 | fail | comparison |
| 25 | pass | −15.2 | fail | 300 | 3.9 | fail | comparison |
| 26 | pass | 110.9 | pass | 300 | 0.6 | pass | invention |
| 27 | fail | 180.0 | pass | 300 | 3.1 | fail | comparison |
| 28 | pass | 211.3 | pass | 300 | 1.5 | pass | invention |

In the examples of the invention where electro-magnetic stirrer (EMS) was employed, and the molten steel was discharged from the submerged nozzle upward from the horizontal direction to satisfy the expressions (1) and (2), the defect occurrence rate was suppressed to low in all the cold rolled annealed steel sheets, from which the effect of significantly suppressing the phenomenon that foreign matters in the molten steel were entrained into the solidification shell in the continuous casting was confirmed.

On the other hand, in Nos. 13 to 18, due to the discharge direction with M/W exceeding 0.45 and too large L−0.17Vi, the temperature of the molten steel surface was not retained sufficiently high. As a result, the entrainment of foreign matter was increased to provide a high defect occurrence rate of the cold rolled annealed steel sheet. In No. 19, due to the small submerged depth of the submerged nozzle providing the discharge direction with M/W of less than 0.15, the temperature of the molten steel surface was largely decreased in the position near the short edge. As a result, the entrainment of foreign matter was increased. In Nos. 20 and 21, due to the large L with the relatively low discharge velocity Vi, L−0.17Vi became excessive to fail to retain the temperature of the molten steel surface to sufficiently high. As a result, the entrainment of foreign matter was increased. In Nos. 24 and 25, due to the small L with the relatively high discharge velocity Vi, the molten steel surface was largely wavy to increase the entrainment of the mold powder. In No. 24 therein, due to the discharge direction with M/W of less than 0.15, the unevenness of the temperature of the molten steel surface was increased to increase further the entrainment of foreign matters. In No. 27, due to the discharge direction with M/W exceeding 0.45, the temperature of the molten steel surface was not retained sufficiently high. As a result, the entrainment of foreign matter was increased.

Example 2

The influence of the electro-magnetic stirrer on the effect of suppressing the entrainment of foreign matters was investigated by utilizing a part of the ingot charges shown in Table 2A. The continuous casting conditions and the state of defect occurrence of the cold rolled annealed steel sheets are shown in Table 3. The items shown therein the same as in Table 2A. The numeral of the example No. in Table 3 corresponds to the numeral of the example No. in Table 2A, and the examples with the same numeral uses the same ingot charge. Only the electro-magnetic stirrer condition was changed stepwise for the same ingot charge, and coils of cold rolled annealed steel sheets were produced in the same manner as in Example 1 by using the cast pieces (continuous cast slabs) produced under the respective electro-magnetic stirrer conditions, and subjected to the surface inspection. The inspection method was the same as in Example 1. The examples with an electro-magnetic stirrer flow velocity of 300 mm/s in Table 3 are re-posting of the examples shown in Table 2A. The examples with an electro-magnetic stirrer flow velocity of 0 mm/s each mean that no electro-magnetic stirring is performed.

TABLE 3

| Example No. | Mold size Short edge (mm) | Mold size Long edge W (mm) | Submerged nozzle Depth H of center of outlet opening (mm) | Submerged nozzle Discharge angle θ (°) | Casting rate (m/min) | Discharge velocity Vi (mm/s) | Geometric distance M (mm) | Geometric distance L (mm) | Expression (1) M/W | Expression (1) Judgement of sufficiency |
|---|---|---|---|---|---|---|---|---|---|---|
| 1a<br>1b | 200 | 1250 | 180 | 30 | 1.00 | 904.2 | 364.3 | 360.0 | 0.291 | pass |
| 2a<br>2b | 200 | 1570 | 180 | 30 | 1.00 | 1135.7 | 364.3 | 360.0 | 0.232 | pass |

TABLE 3-continued

| | | | | | | | | | | |
|---|---|---|---|---|---|---|---|---|---|---|
| 4a | 200 | 1030 | 180 | 30 | 0.91 | 678.0 | 364.3 | 360.0 | 0.354 | pass |
| 4b | | | | | | | | | | |
| 5a | 200 | 1250 | 180 | 30 | 0.95 | 859.0 | 364.3 | 360.0 | 0.291 | pass |
| 5b | | | | | | | | | | |
| 5c | | | | | | | | | | |
| 5d | | | | | | | | | | |
| 7a | 200 | 1030 | 130 | 30 | 1.40 | 1043.1 | 277.7 | 260.0 | 0.270 | pass |
| 7b | | | | | | | | | | |
| 10a | 200 | 1030 | 110 | 30 | 1.00 | 745.1 | 243.0 | 220.0 | 0.236 | pass |
| 10b | | | | | | | | | | |
| 10c | | | | | | | | | | |

| | Expression (2) | | Flow velocity by electro-magnetic | Cold rolled annealed steel sheet | | |
|---|---|---|---|---|---|---|
| Example No. | L-0.17Vi | Judgement of sufficiency | stirrer (mm/s) | Defect occurrence rate (%) | Evaluation of defect occurrence | Class |
| 1a | 206.3 | pass | 0 | 4.0 | fail | comparison |
| 1b | | | 300 | 2.1 | pass | invention |
| 2a | 166.9 | pass | 0 | 1.9 | fail | comparison |
| 2b | | | 300 | 0.8 | pass | invention |
| 4a | 244.7 | pass | 0 | 3.2 | fail | comparison |
| 4b | | | 300 | 1.4 | pass | invention |
| 5a | 214.0 | pass | 0 | 3.7 | fail | comparison |
| 5b | | | 200 | 2.1 | pass | invention |
| 5c | | | 300 | 0.9 | pass | invention |
| 5d | | | 500 | 2.0 | pass | invention |
| 7a | 82.7 | pass | 300 | 1.7 | pass | invention |
| 7b | | | 500 | 1.2 | pass | invention |
| 10a | 93.3 | pass | 0 | 4.5 | fail | comparison |
| 10b | | | 200 | 1.0 | pass | invention |
| 10c | | | 300 | 2.3 | pass | invention |

It is understood that the effect of suppressing the entrainment of foreign matters is not sufficiently exhibited in the case where electro-magnetic stirring is not performed even though the condition satisfying the expressions (1) and (2) is employed.

REFERENCE SIGN LIST

10 long edge direction
11A, 11B mold
12A, 12B long edge surface
20 short edge direction
21A, 21B mold
22A, 22B short edge surface
30 submerged nozzle
31 discharge port
32 outlet opening of discharge port
40 molten steel
41 molten steel surface
42 solidification shell
51 discharge direction
52 discharge extended line
60A, 60B flow direction of molten steel by electro-magnetic stirrer
70A, 70B electro-magnetic stirrer device

The invention claimed is:

1. A continuous casting method for steel, using a mold having an inner surface of the mold in a rectangular profile shape cut in a horizontal plane, two inner wall surfaces of the mold constituting long edges of the rectangular shape each are referred to as a "long edge surface", two inner wall surfaces of the mold constituting short edges thereof each are referred to as a "short edge surface", a horizontal direction in parallel to the long edge surface is referred to as a "long edge direction", and a horizontal direction in parallel to the short edge surface is referred to as a "short edge direction", the continuous casting method comprising: disposing a submerged nozzle having two discharge ports, at a center in the long edge direction and the short edge direction in the mold; discharging a molten steel from each of the discharge ports under the following conditions (A) and (B); and applying electric power to the molten steel in a region having a depth providing a thickness of a solidification shell of from 5 to 10 mm at least at a center position in the long edge direction, so as to cause flows in directions inverse to each other in the long edge direction on both long edge sides, thereby performing electro-magnetic stirrer (EMS):

(A) an extended line of a central axis of a discharged flow of the molten steel at an outlet opening of the discharge port of the submerged nozzle (which is hereinafter referred to as a "discharge extended line") intersects a molten steel surface in the mold at a point P, and the molten steel is discharged from the discharge port of the submerged nozzle in a direction upward from the horizontal direction with a position of the point P satisfying the following expression (1):

$$0.15 \leq M/W \leq 0.45 \quad (1)$$

wherein W represents a distance (mm) between the short edges facing each other at a level of the molten steel surface, and M represents a distance (mm) in the long edge direction from a center position in the long edge direction between the short edges facing each other to the point P; and (B) the molten steel is discharged from the discharge ports of the submerged nozzle to satisfy the following expression (2):

$$0 \leq L - 0.17Vi \leq 350 \quad (2)$$

wherein L represents a distance (mm) from a center position of the outlet opening of the discharge port of the submerged nozzle to the point P, and Vi represents a discharge velocity (mm/s) of the molten steel at the outlet opening of the discharge port.

2. The continuous casting method according to claim 1, wherein the two discharge ports of the submerged nozzle each have an area of the outlet opening viewed in a discharge direction of from 950 to 3,500 $mm^2$.

3. The continuous casting method according to claim 1, wherein L in the expression (2) is 450 mm or less.

4. The continuous casting method according to claim 1, wherein a casting rate is 0.90 m/min or more.

5. The continuous casting method according to claim 1, wherein the steel is a stainless steel having a C content of 0.12% by mass or less and a Cr content of from 10.5 to 32.0% by mass.

6. The continuous casting method according to claim 1, wherein the steel is a ferritic stainless steel containing, in terms of percentage by mass, from 0.001 to 0.080% of C, from 0.01 to 1.00% of Si, from 0.01 to 1.00% of Mn, from 0 to 0.60% of Ni, from 10.5 to 32.0% of Cr, from 0 to 2.50% of Mo, from 0.001 to 0.080% of N, from 0 to 1.00% of Ti, from 0 to 1.00% of Nb, from 0 to 1.00% of V, from 0 to 0.80% of Zr, from 0 to 0.80% of Cu, from 0 to 0.30% of Al, from 0 to 0.010% of B, and the balance of Fe, with unavoidable impurities.

* * * * *